US010240248B2

(12) United States Patent
Van Valkenburg et al.

(10) Patent No.: US 10,240,248 B2
(45) Date of Patent: Mar. 26, 2019

(54) ADAPTIVE ELECTRIC FIELD SHIELDING IN AN ELECTROPLATING PROCESSOR USING AGITATOR GEOMETRY AND MOTION CONTROL

(71) Applicant: APPLIED Materials, Inc., Santa Clara, CA (US)

(72) Inventors: Paul Van Valkenburg, Whitefish, MT (US); Robert Mikkola, Kalispell, MT (US); John L. Klocke, Proctor, MT (US); Paul R. McHugh, Kalispell, MT (US); Gregory J. Wilson, Kalispell, MT (US); Kyle Moran Hanson, Kalispell, MT (US); Eric J. Bergman, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 203 days.

(21) Appl. No.: 15/232,970

(22) Filed: Aug. 10, 2016

(65) Prior Publication Data

US 2017/0051423 A1 Feb. 23, 2017

Related U.S. Application Data

(60) Provisional application No. 62/206,702, filed on Aug. 18, 2015.

(51) Int. Cl.
*C25D 17/00* (2006.01)
*C25D 5/02* (2006.01)
(Continued)

(52) U.S. Cl.
CPC ..... *C25D 21/10* (2013.01); *C25D 5/02* (2013.01); *C25D 7/12* (2013.01); *C25D 17/001* (2013.01);
(Continued)

(58) Field of Classification Search
CPC . C25D 5/02; C25D 5/08; C25D 21/10; C25D 17/001
See application file for complete search history.

(56) References Cited

U.S. PATENT DOCUMENTS 4,102,756 A 7/1978 Castellani et al.
6,027,631 A * 2/2000 Broadbent ..... C25D 5/16 204/212

(Continued)

FOREIGN PATENT DOCUMENTS

WO 2008-094838 A2 8/2008

OTHER PUBLICATIONS

International Application Division, Korean Intellectual Property Office, "The International Search Report and the Written Opinion" issued in International Application No. PCT/US2016/047048 (dated Nov. 22, 2016).

*Primary Examiner* — Brian W Cohen
(74) *Attorney, Agent, or Firm* — Perkins Coie LLP; Kenneth H. Ohriner

(57) ABSTRACT

In electroplating apparatus, a paddle or agitator agitates electrolyte in a vessel to provide high velocity fluid flow at the surface of a wafer. The agitator is designed and/or moved to also selectively shield part of the wafer, for example the edge of the wafer, from the electric field in the vessel. Selectively shielding may be achieved by temporally shifting the average position of the agitator towards one side of the wafer, by omitting or shortening slots in the agitator, and/or by synchronizing movement of the agitator with rotation of the wafer.

9 Claims, 9 Drawing Sheets

(51) Int. Cl.
*C25D 7/12* (2006.01)
*C25D 21/10* (2006.01)
*C25D 17/06* (2006.01)

(52) U.S. Cl.
CPC ..... *C25D 17/06* (2013.01); *C25D 17/002* (2013.01); *C25D 17/008* (2013.01)

(56) References Cited

U.S. PATENT DOCUMENTS

| | | | | |
|---|---|---|---|---|
| 6,156,167 | A * | 12/2000 | Patton | C25D 7/12 204/270 |
| 6,251,250 | B1 | 6/2001 | Keigler | |
| 6,773,559 | B2 | 8/2004 | Woodruff et al. | |
| 7,390,382 | B2 | 6/2008 | McHugh et al. | |
| 7,390,383 | B2 | 6/2008 | McHugh et al. | |
| 7,393,349 | B2 | 7/2008 | McHugh et al. | |
| 7,842,173 | B2 | 11/2010 | McHugh | |
| 7,931,786 | B2 | 4/2011 | Wilson et al. | |
| 2005/0006241 | A1 | 1/2005 | McHugh et al. | |
| 2005/0051425 | A1 | 3/2005 | Wang et al. | |
| 2007/0151844 | A1 * | 7/2007 | Wilson | C25D 5/18 204/230.2 |
| 2014/0251814 | A1 * | 9/2014 | Kao | C25D 21/12 205/96 |

* cited by examiner

*Paddle Shifted 20mm to the Left*

ADAPTIVE ELECTRIC FIELD SHIELDING IN AN ELECTROPLATING PROCESSOR USING AGITATOR GEOMETRY AND MOTION CONTROL

PRIORITY CLAIM

This application claims priority to U.S. Provisional Application No. 62/206,702, filed Aug. 18, 2015.

BACKGROUND OF THE INVENTION

Existing electroplating processors used for wafer level packaging (WLP) and other applications generally use replaceable shields and anode current adjustments to compensate for process variations. Examples of process variations include changes in the electrolyte bath conductivity and chemical make-up, different seed sheet resistance values, and different wafer patterns. The shields are typically dielectric material rings dimensioned and positioned to provide an appropriate level of electric field shielding around the edge of the wafer. However, shields must be manually changed to compensate for process variations, interrupting operation of the electroplating processor. It may also be difficult to determine which shields to use for a specific process condition, so that time-consuming trial-and-error experiments must be performed. Sets of shields must also be manufactured and inventoried so that they are available for use as needed. Accordingly, improved techniques are needed for compensating for process variations in electroplating processors.

SUMMARY OF THE INVENTION

In one aspect, an electroplating processor includes a head having a wafer holder for holding and making electrical contact with a wafer, with the head movable to position the wafer holder in the vessel, at least one anode in the vessel, an agitator in the vessel and an actuator attached to the agitator for moving the agitator horizontally within the vessel. The agitator has an array of ribs and slots, and with a first side of the agitator having fewer slots than a second side of the agitator, and/or with the slots on the first side of the agitator shorter than the slots on the second side of the agitator.

In another aspect, an electroplating method includes placing a wafer into contact with liquid electrolyte in a vessel, conducting electric current through the liquid electrolyte, and moving an agitator in the electrolyte, below the wafer, with a movement that selectively shields a portion of the wafer. The agitator may be moved with a stagger movement so that the time-averaged presence of the agitator over a first side of the wafer is greater than over a second side of the wafer. The wafer is optionally rotated, with or without synchronizing rotation of the wafer with movement of the agitator. The method may use the agitator having slots as described above.

BRIEF DESCRIPTION OF THE DRAWINGS

In the drawings, the same reference number indicates the same element in each of the views.

DETAILED DESCRIPTION

Figure 1:
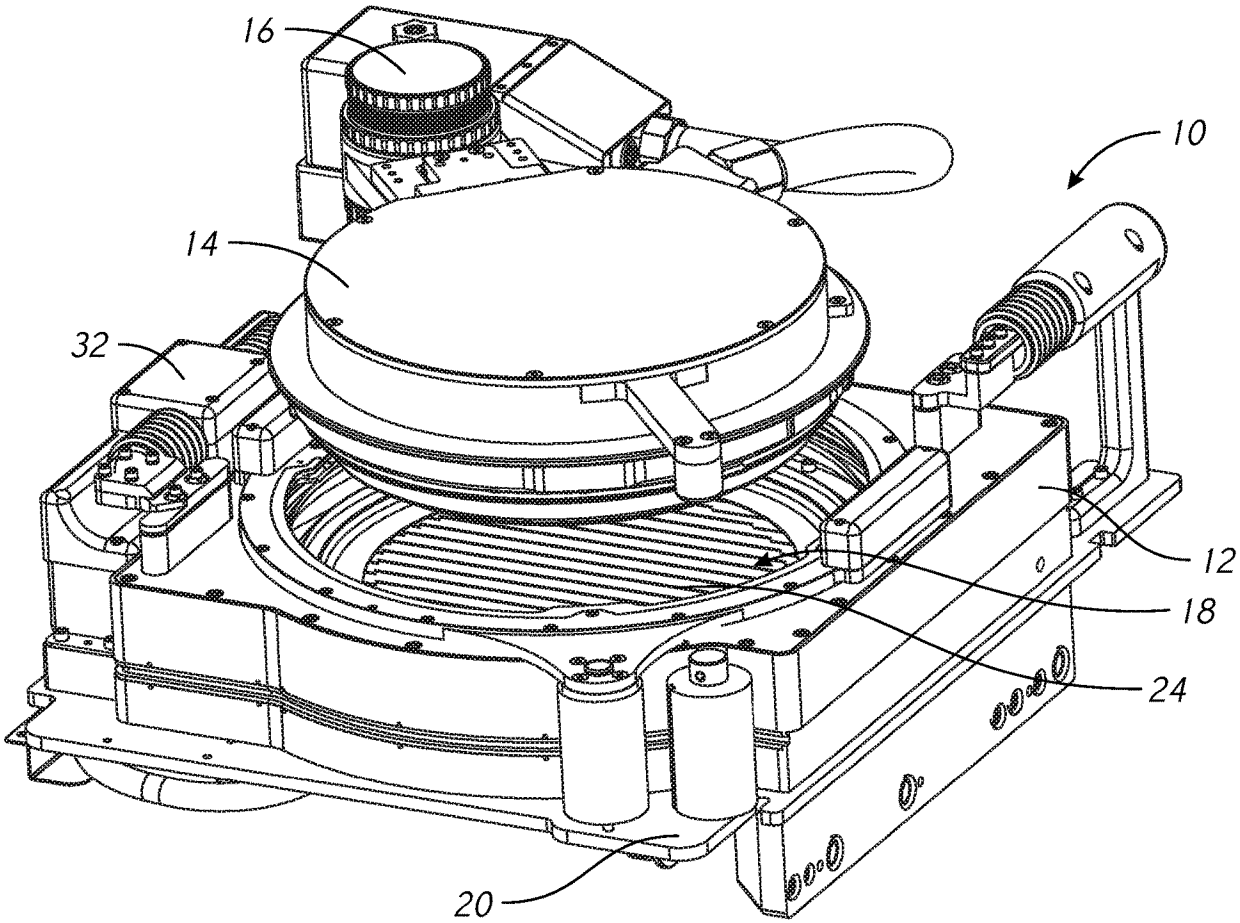
FIG. 1 is a top perspective view of an electroplating apparatus.
Figure 2:
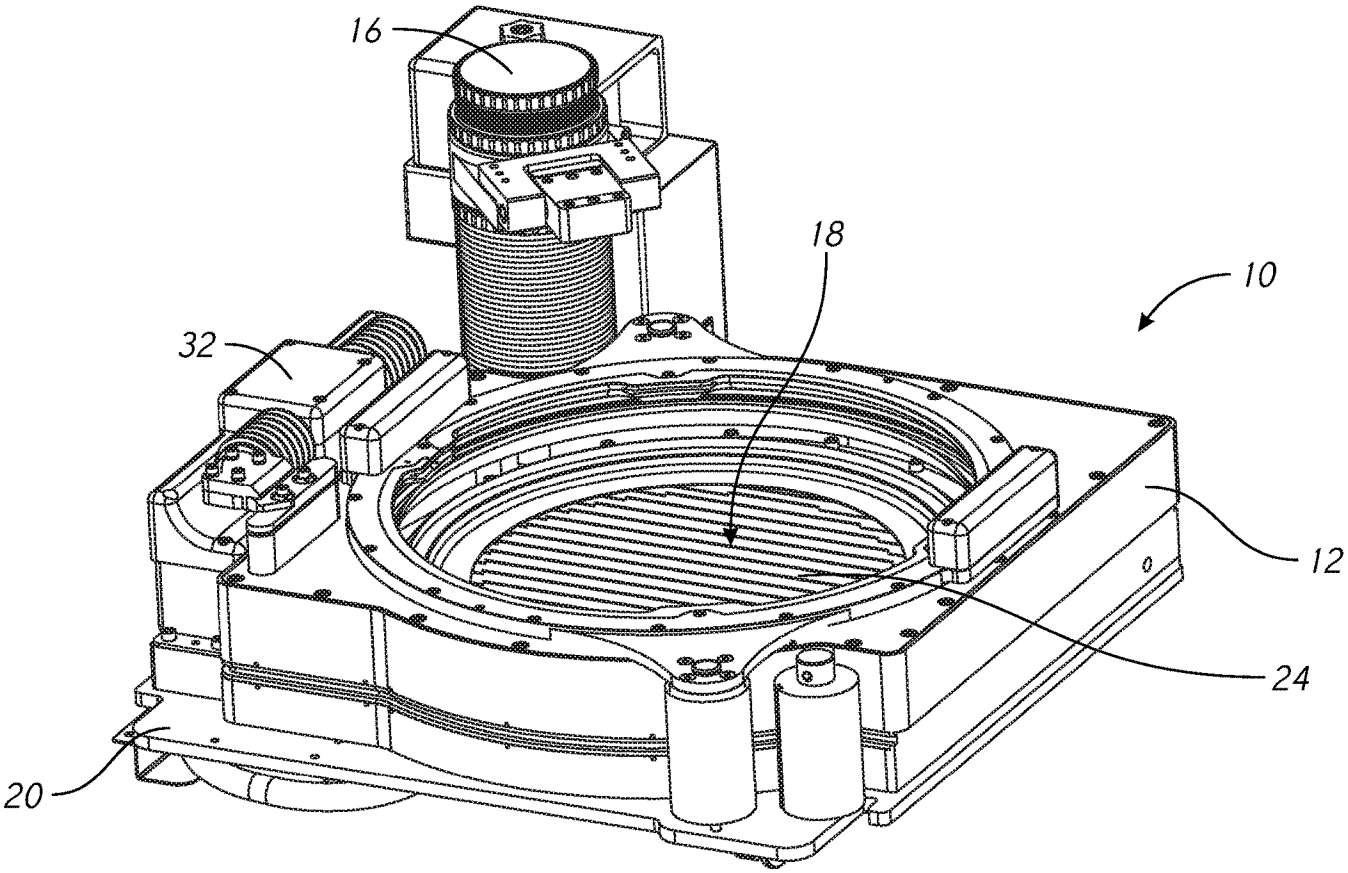
FIG. 2 is a top perspective view of the apparatus of FIG. 1 with the head removed for purpose of illustration.
Figure 3:
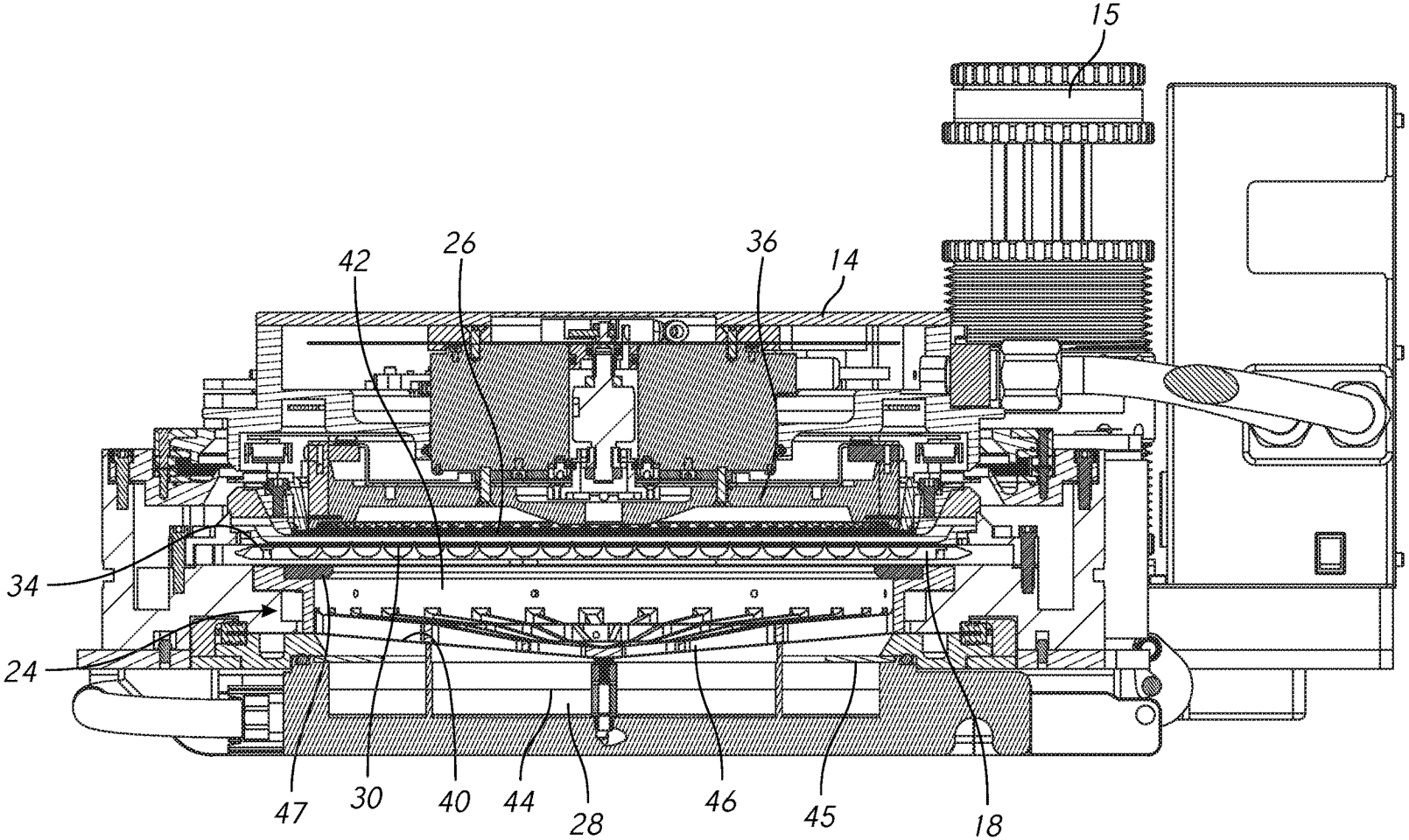
FIG. 3 is a section view of the apparatus of FIG. 1.

As shown in FIGS. 1-3, a processor 10 for electroplating a wafer 30 includes a head 14 supported on a head lifter 16 and a vessel 24. A membrane 40 may be included to divide the vessel 24 into a lower chamber 44 containing one or more anodes 28, with a first liquid electrolyte or anolyte, below the membrane 40, and an upper chamber 42 containing a second liquid electrolyte or catholyte. Alternatively the membrane 40 may be omitted with the vessel 24 having a single chamber holding a single electrolyte. Referring to FIG. 3, a field shaping element 46 made of a dielectric material may be provided in the vessel 24 primarily to support the membrane 40, and distribute flow of catholyte. In a typical design as shown in FIG. 3, an anode shield 45, a chamber shield 47, and a weir shield 34 may be provided, as examples of the types of shields that must be changed over to compensate for process variations, as discussed above.

Referring still to FIG. 3, a contact ring 26 on the head 14 holds the wafer 30 and has a plurality of contact fingers for making electrical contact with a conductive layer, such as a metal seed layer, on the wafer 30. The contact ring 26 may optionally have a seal to seal the contact fingers from the electrolyte. Typically the contact ring has a seal and a backing plate, with the contact ring and the backing plate forming a wafer holder. The head 14 may include a rotor 36 for rotating the wafer 30 during processing, with the contact ring 26 on the rotor. The head 14 is movable to position the wafer holder into a processing position in the vessel, where the seed layer is in contact with electrolyte in the vessel.

Figure 4:
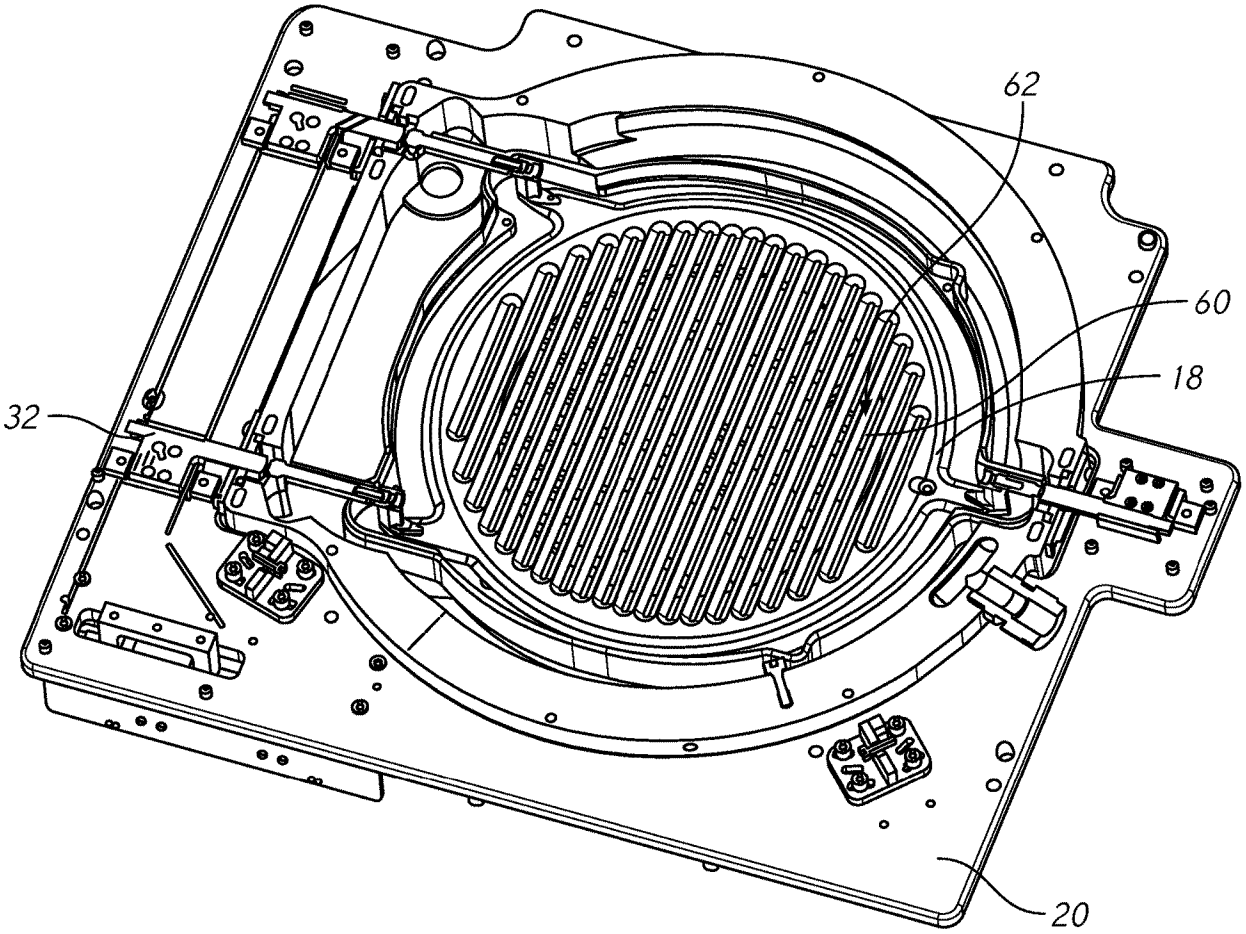
FIG. 4 is a top perspective view of the agitator shown in the apparatus of FIGS. 1-3.

Referring now also to FIG. 4, a typical paddle or agitator 18 is at a fixed vertical position within the vessel 24 adjacent to the wafer 30. The agitator 18 may be a generally circular plate of dielectric material having a plurality of parallel ribs or blades 60 spaced apart by slots 62. An actuator 32 moves the agitator 18 horizontally in a flat plane, parallel to the wafer, within the vessel 24 to agitate the electrolyte. The agitator 18 and the actuator 32 may be supported on a base plate 20 attached to the vessel 24. The wafer may be rotating or stationary. The slots allow ionic current to pass through the agitator 18.

The ribs and slots may be parallel to each other, and may be equally spaced apart in an array. The agitator may be a round and flat dielectric material, with a thickness or rib height of 7-30 mm. The agitator may be symmetrical about a centerline parallel to the ribs, with the left side of the agitator a mirror image of the right side, except for the modifications discussed above.

In the present adaptive shielding apparatus and methods, the agitator itself is used as an electric field shield, and the need to use and/or manually change shields (such as the shields 45, 47 and/or 34) may be avoided. In typical operation, the agitator 18 may move with a (~6-10 Hz) oscillation, and with a stroke that is about ½ to 1× the agitator blade pitch. A secondary low frequency oscillation may be used to shift the blade reversal points to avoid imprinting either an electric field or mass transfer signature on the wafer (i.e., stripes on a stationary wafer, and rings on a rotating wafer). This secondary oscillation is referred to as the stagger motion. The stagger motion envelope may be roughly equal to the blade pitch.

Typically, the agitator/agitator stroke is ½ the blade pitch and the stagger envelop is equal to the blade pitch. In this case the total motion envelop is roughly 1.5× the blade pitch, with the motion envelop centered beneath the wafer. In the present design, however, the agitator design and motion profile are selected to create adjustable wafer edge shielding.

Adaptive shielding may be provided in the following ways.

Example 1

Figure 5:
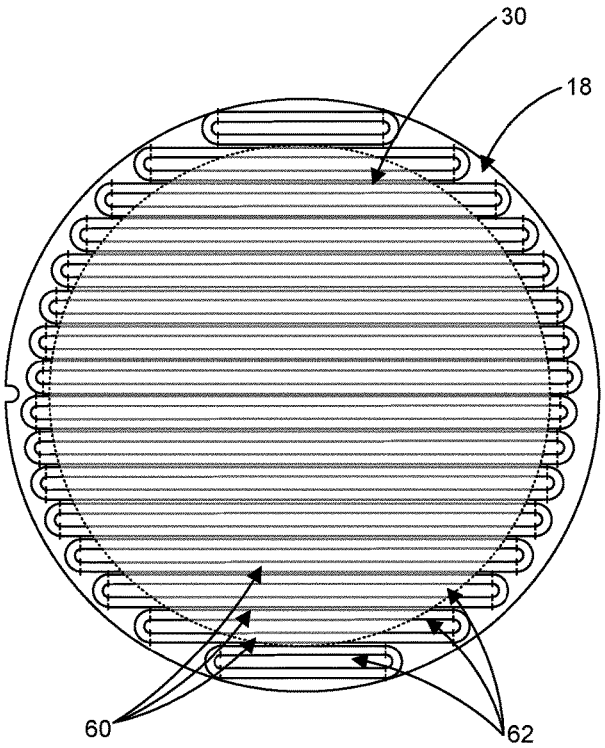
FIG. 5 is a top view of an agitator centered below a wafer.
Figure 6:
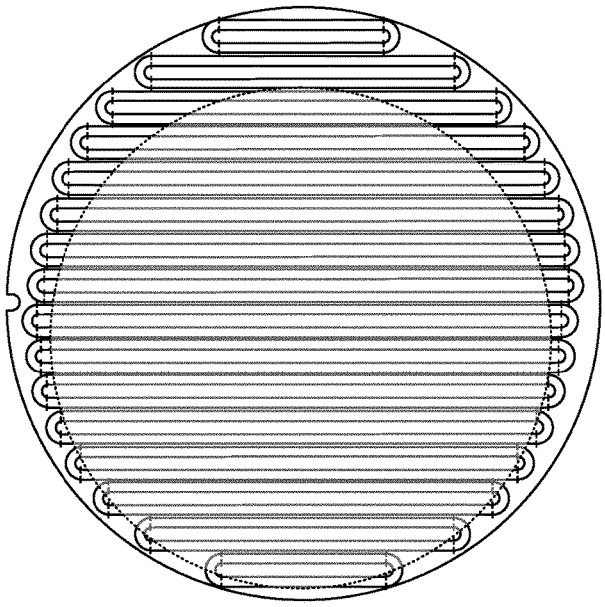
FIG. 6 is a top view of the agitator of FIG. 5 shifted by a first dimension away from a first side EE of the wafer.
Figure 7:
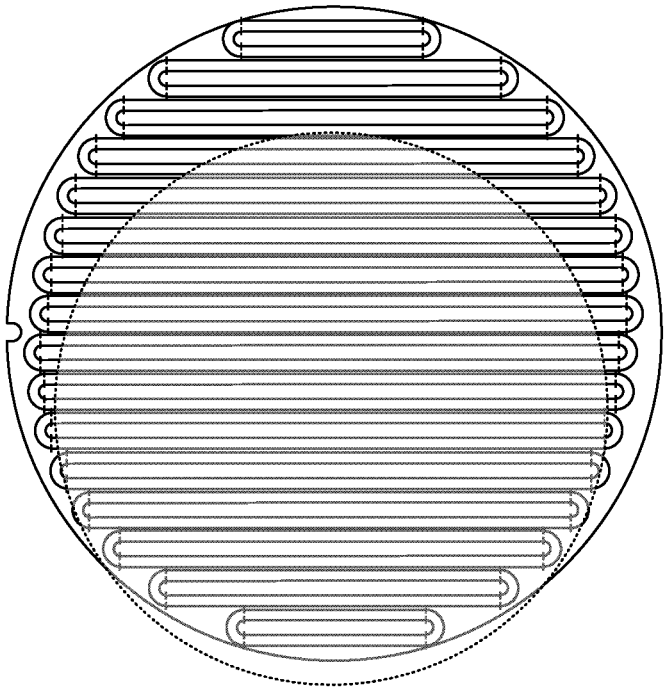
FIG. 7 is a top view of the agitator of FIG. 5 now shifted by a second dimension away from the first side EE of the wafer.

Referring to FIGS. 5-7, adaptive shielding may be provided by shifting the center point of the agitator motion away from the wafer center. This causes selective shielding of one end EE of the wafer 30 as the wafer rotates past this region. Averaging due to wafer rotation provides a uniform level of edge shielding. The off-center shift distance can be used to control the amount of edge shielding. An asymmetric shield effect can be achieved if wafer rotation is not used or is limited to small angular values so that the edge shielding is concentrated in a specific region of the wafer.

Example 2

A larger stagger motion envelop may also be used to create periodic edge shielding on both sides of the wafer. With this approach various degrees of edge shielding can be obtained by adjusting the stagger motion distance.

Example 3

Figure 8:
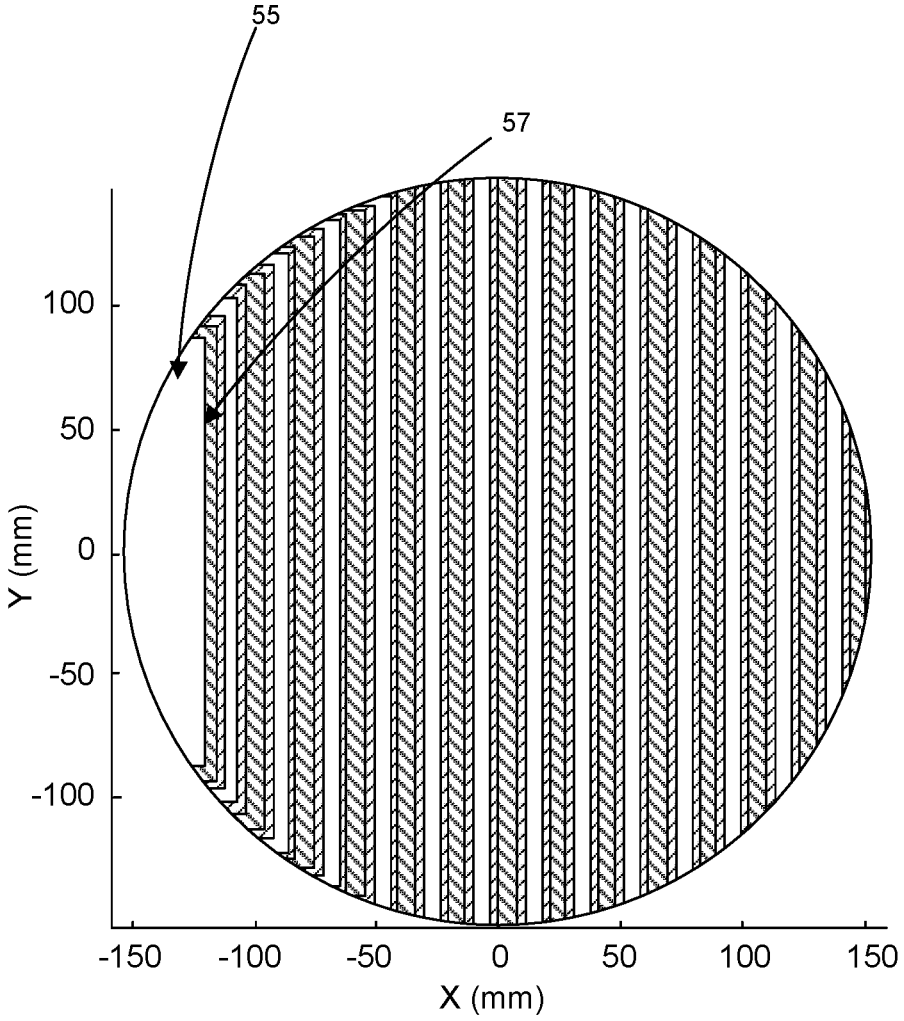
FIG. 8 is a model of a modified agitator having slots removed at one side.

Another technique is to block select portions of the outer slots 62 of the agitator 18. This approach enables wafer edge shielding on one or both sides of the agitator without needing a large shift in the motion center point. FIG. 8 shows a computational model where the leftmost two slots in the agitator are removed, so that the left end of the agitator has a solid crescent shape area 55, to provide a shielding effect via the agitator modeled in FIG. 8. The modeling in FIG. 8 uses wafer patterns with a large (15 mm square) die and no partial die along the wafer perimeter. This type of wafer pattern leads to large un-patterned regions along the edge of the wafer, which presents a significant edge shielding challenge. FIG. 8 illustrates that this agitator-shield approach defines a chord line 57 on a stationary wafer, beyond which there is significant shielding in the crescent shaped area 55.

Example 4

Figure 9A:
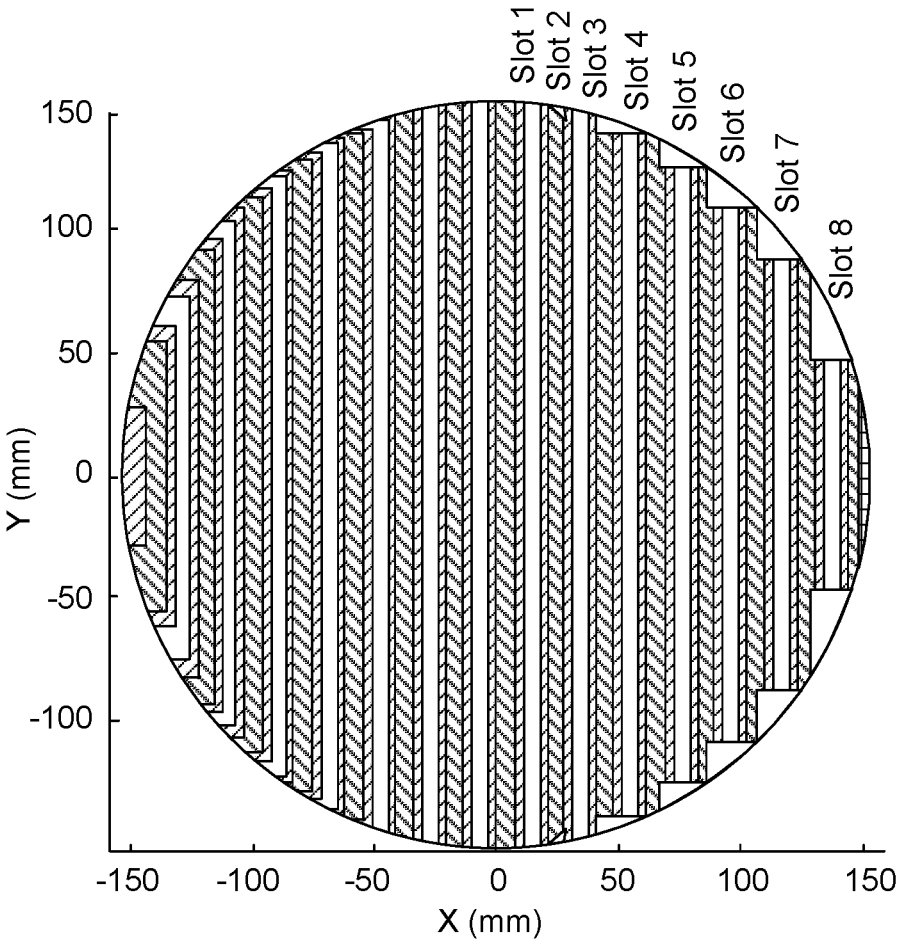
FIG. 9A is a model of a modified agitator having slots on one side shortened to provide electric field shielding.

Adaptive shielding may also be provided by adjusting the discrete slot lengths of the agitator and the agitator motion to create various degrees of edge shielding. FIG. 9A shows an example where slots 3-8 (counting outward from slot 1 at or near the center) are made shorter, with the amount of shortening increasing from the center towards the edge. Side-to-side shielding variation may be achieved by synchronizing the wafer rotation rate with the agitator stagger motion (e.g., 2× stagger motion=40 mm, stagger frequency=0.17 Hz, and wafer rotation rate=10.36 rpm with 2 rotations). The slot length adjustments can be symmetric with respect to the agitator centerline or nonsymmetric, or a combination of both symmetric and non-symmetric adjustments.

The slot length modification may be performed on only half of the agitator with the length adjustment for a given slot symmetric about a line perpendicular to the slot length. Unlike the shielding approach shown in FIG. 8, where the shield shape is defined by a chord line, a slot length adjustment may lead to a broader distribution of shielding along the edge of the wafer.

Example 5

Local shielding may also be achieved by synchronizing the agitator motion with the wafer rotation. This approach may be useful for shielding a local region on the wafer such as photo-resist covered notch/scribe region. Another example of this approach may be for patterned wafers without "dummy bumps". In this case, square or rectangular shaped die are fit within the round wafer with no partial dies allowed. This leads to an irregular open area pattern where the dies extend closer to the wafer edge along the directions that are parallel to the die edges, e.g. at 0, 90, 180, and 270 degrees.

Conversely, the highest un-patterned areas occur at 45, 135, 225, and 315 degrees. This situation offers the opportunity to align the un-patterned areas of the wafer with the highest shielding offered by agitator motion. For example, if the highest shielding is at one end of the agitator because its motion center is shifted away from the wafer center, then the wafer can be oriented so that the 45, 135, 225, or 315 degree regions are aligned with the high shielding end of the agitator.

The wafer need not be continuously rotated. Rather the wafer may be periodically clocked 90 degrees so that the 45, 135, 225, and 315 degree regions preferentially share time at the high shielding end of the agitator. Other rotation/agitation synchronizations are possible with the goal of aligning the highest un-patterned regions of the wafer with the highest shielding conditions offered by the agitator motion and geometry.

Example 6

Figure 9B:
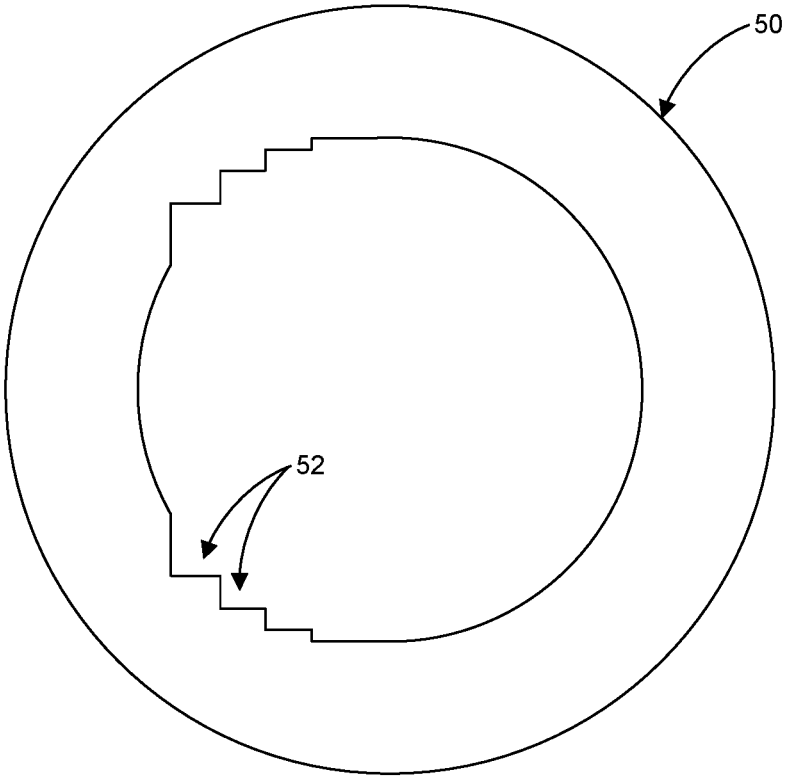
FIG. 9B is a diagram of shield having notches.

A stationary shield 50 beneath the agitator may be constructed with discrete notch openings 52, as shown in FIG. 9B. When the agitator slot openings are aligned with these notches, there is no additional shielding. In contrast, when the agitator slot openings are not aligned with the discrete notch openings, additional edge shielding is provided. The agitator motion profile can be used to control the amount of edge shielding by controlling the time during which the agitator slots are aligned or not aligned with the stationary shield notch openings.

As an alternative to discrete notch openings, one or all of the shields 45, 47 and 34 may be replaced with a diffuser plate with discrete holes along the outer perimeter. The agitator slot openings can similarly be aligned with or not aligned with the diffuser holes to vary the amount of edge shielding. The examples listed above may be combined to obtain different forms of adaptive edge shielding. Some approaches, such as examples 1 and 2 above, may require a larger motion envelope, but offer the advantage that the shielding can be "turned off" if the typical motion profile is used. The method of example 3 above may induce a shielding effect that cannot be "turned off", but this may be acceptable if this shielding replaces the effect of an existing shield such as the chamber shield.

These examples illustrate two different implementation approaches:

(A.) The adaptive shielding of the agitator is used to augment a processor having conventional shields (such as shields 45, 47 and 34) in place in the vessel. For example, chamber shields are selected for wafer patterns with "dummy bumps". Typical agitator motion profiles are used for these 'baseline' wafer types. For wafer patterns without "dummy bumps" that need more edge shielding, the agitator motion profile is modified to create the desired level of edge shielding.

(B.) The adaptive shielding of the agitator is used to replace one or more of the shields. In this case, the agitator geometry and motion may be used to achieve the desired level of edge shielding. In this case the processor may have no shields in the vessel.

The invention may be characterized in one embodiment as an electroplating processor comprising a head having a wafer holder for holding and making electrical contact with a wafer, with the head movable to position the wafer holder in a vessel holding an electrolyte, and with at least one anode in the vessel. An agitator in the vessel has an array of ribs and slots, with a first side of the agitator having fewer slots than a second side of the agitator. An actuator is attached to the agitator for moving the agitator horizontally within the vessel.

In another embodiment, the invention may be characterized by an electroplating processor having a head with a wafer holder for holding and making electrical contact with a wafer. The head is movable to position the wafer holder in a vessel having at least one anode in the vessel. An agitator in the vessel has a pattern of ribs and slots, with slots on a first side of the agitator shorter than slots on a second side of the agitator. An actuator is attached to the agitator for moving the agitator horizontally within the vessel.

An electroplating method includes placing a wafer into contact with liquid electrolyte in a vessel, and conducting electric current through the liquid electrolyte. An agitator is moved below the wafer with a movement that selectively shields a portion of the wafer. The agitator may have a stagger movement so that the time-averaged presence of the agitator over a first side of the wafer is greater than over a second side of the wafer. The method optionally further includes rotating the wafer. If used, the rotation may be synchronized with movement of the agitator.

Selectively shielding means shielding one area of the wafer more than other areas of the wafer. Selectively shielding may be achieved by temporally shifting the average position of the agitator towards one side of the wafer, by omitting or shortening slots in the agitator, and/or by synchronizing movement of the agitator with rotation of the wafer.

The invention claimed is:

1. An electroplating method, comprising:

placing a wafer into contact with liquid electrolyte in a vessel;

conducting ionic current through the liquid electrolyte;

moving an agitator below the wafer with a horizontal movement that selectively shields a portion of the wafer; and rotating the wafer and synchronizing the rotation of the wafer with the movement of the agitator.

2. The method of claim 1 with the agitator having an array of ribs and slots, and with a first side of the agitator having fewer slots than a second side of the agitator.

3. The method of claim 1 with the agitator having an array of ribs and slots, and with the slots on a first side of the agitator shorter than the slots on a second side of the agitator.

4. An electroplating method, comprising:

placing a wafer into contact with liquid electrolyte in a vessel;

conducting ionic current through the liquid electrolyte;

moving an agitator below the wafer with a movement that selectively shields a portion of the wafer;

with the agitator having a stagger movement so that the time-averaged presence of a first side of the agitator over a first side of the wafer is greater than over a second side of the wafer.

5. The method of claim 4 with the agitator having an array of ribs and slots, and with a first side of the agitator having fewer slots than a second side of the agitator.

6. The method of claim 4 with the agitator having an array of ribs and slots, and with the slots on a first side of the agitator shorter than the slots on a second side of the agitator.

7. An electroplating method, comprising:

placing a wafer into contact with liquid electrolyte in a vessel;

conducting ionic current through the liquid electrolyte;

moving an agitator below the wafer with a movement that selectively shields a portion of the wafer;

with the agitator having an array of ribs, a top side, a bottom side, a first side and a second side, and with the first side of the agitator having fewer ribs than the second side of the agitator.

8. The method of claim 7 further including rotating the wafer and synchronizing the rotation of the wafer with the movement of the agitator.

9. The method of claim 7 with the ribs on the first side of the agitator shorter than the ribs on the second side of the agitator.

* * * * *